US009656514B2

(12) United States Patent
Mills, II

(10) Patent No.: US 9,656,514 B2
(45) Date of Patent: May 23, 2017

(54) PAINT PAL ASSEMBLY

(71) Applicant: Roger Kent Mills, II, Abilene, TX (US)

(72) Inventor: Roger Kent Mills, II, Abilene, TX (US)

( * ) Notice: Subject to any disclaimer, the term of this patent is extended or adjusted under 35 U.S.C. 154(b) by 83 days.

(21) Appl. No.: 13/694,636

(22) Filed: Dec. 19, 2012

(65) Prior Publication Data

US 2014/0203016 A1 Jul. 24, 2014

Related U.S. Application Data

(63) Continuation-in-part of application No. 12/265,679, filed on Nov. 5, 2008, now abandoned.

(51) Int. Cl.
*B05C 17/02* (2006.01)
*B44D 3/12* (2006.01)

(52) U.S. Cl.
CPC ..... *B44D 3/126* (2013.01); *B44D 3/12* (2013.01)

(58) Field of Classification Search
CPC ..... B44D 3/12; B44D 3/126
USPC .... 206/229, 362; 220/4.27, 23.83, 553, 554, 220/555, 570
See application file for complete search history.

(56) References Cited

U.S. PATENT DOCUMENTS

| | | | | |
|---|---|---|---|---|
| 3,576,252 | A * | 4/1971 | Conolly | B44D 3/04 206/1.7 |
| 4,616,748 | A * | 10/1986 | Thomas et al. | 206/214 |
| 5,460,289 | A * | 10/1995 | Gemmell | 220/495.02 |
| 5,966,772 | A * | 10/1999 | Woodnorth et al. | 15/230.11 |
| 2003/0010783 | A1* | 1/2003 | Prezelin | B65D 51/16 220/324 |
| 2004/0084450 | A1* | 5/2004 | Havens et al. | 220/203.07 |
| 2004/0238399 | A1* | 12/2004 | Billado, Jr. | B05C 17/0245 206/564 |
| 2007/0284375 | A1* | 12/2007 | Perell et al. | 220/316 |
| 2008/0061061 | A1* | 3/2008 | Wang | 220/203.1 |
| 2008/0061063 | A1* | 3/2008 | Kim | 220/315 |

* cited by examiner

*Primary Examiner* — Fenn Mathew
*Assistant Examiner* — Elizabeth Volz
(74) *Attorney, Agent, or Firm* — Delphine James

(57) ABSTRACT

The main components of the Paint Pal assembly is an oversized an inner paint pan, an organizer tool tray for storing tools, and a storage container with an airtight sealed lid. The container is adapted and dimensioned to store the inner paint tray and the organizer tool tray therein. The organizer tool tray has a plurality of compartments for storing several brushes and a specific compartment designed to store the paint roller. The inner paint tray is larger than the conventional paint tray and has legs which allow the pan to sit level on a flat surface. The inner tray is tapered and walled. The assembly further comprises specially designed ergonomic paint brushes.

11 Claims, 17 Drawing Sheets

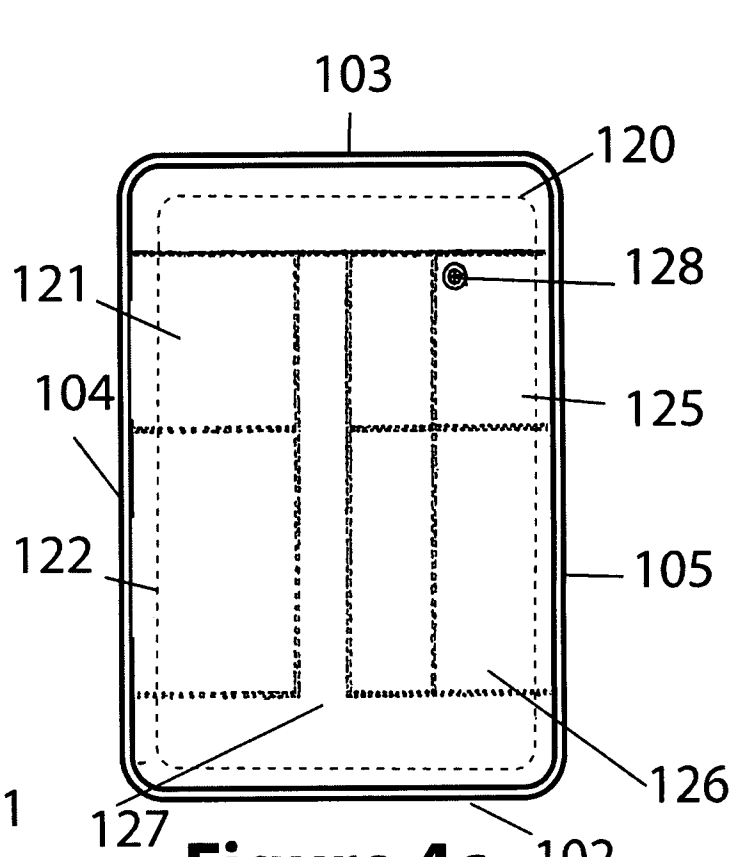
Figure 4c
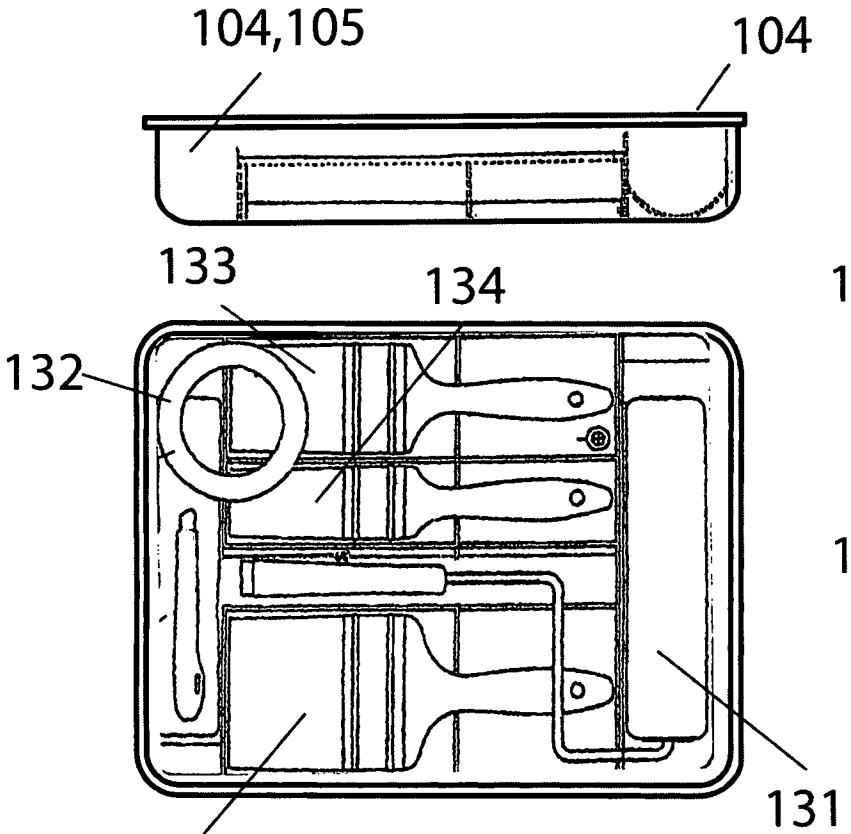
Figure 4d
Figure 4b

PAINT PAL ASSEMBLY

This patent is a continuation in part of application Ser. No. 12/265,679

BACKGROUND

The present invention relates to painting accessories. Many people engage in do-it-yourself home improvements. The present invention is a tool designed to allow the painter to leave wet painting tools sealed in a container for a period of time without drying out.

SUMMARY

One of the main advantages of this invention is to provide a storage container that allows a painter to store their wet paint tools for an extended period of time without drying out.

The main components of the Paint Pal assembly is an oversized an inner paint pan, an organizer tool tray for storing tools, and a storage container with an airtight sealed lid. The container is adapted and dimensioned to store the inner paint pan and the organizer tool tray therein. The organizer tool tray has a plurality of compartments for storing several brushes and a specific compartment designed to store the paint roller. The inner paint pan is larger than the conventional paint pan and has legs which allow the pan to sit level on a flat surface. The inner tray is tapered and walled. The assembly further comprises specially designed ergonomic paint brushes.

BRIEF DESCRIPTION OF DRAWINGS

FIG. 4*a*-4*d* illustrates top view, bottom view, side view, and end view of the tool tray organizer.

DETAILED DESCRIPTION

Figure 6:
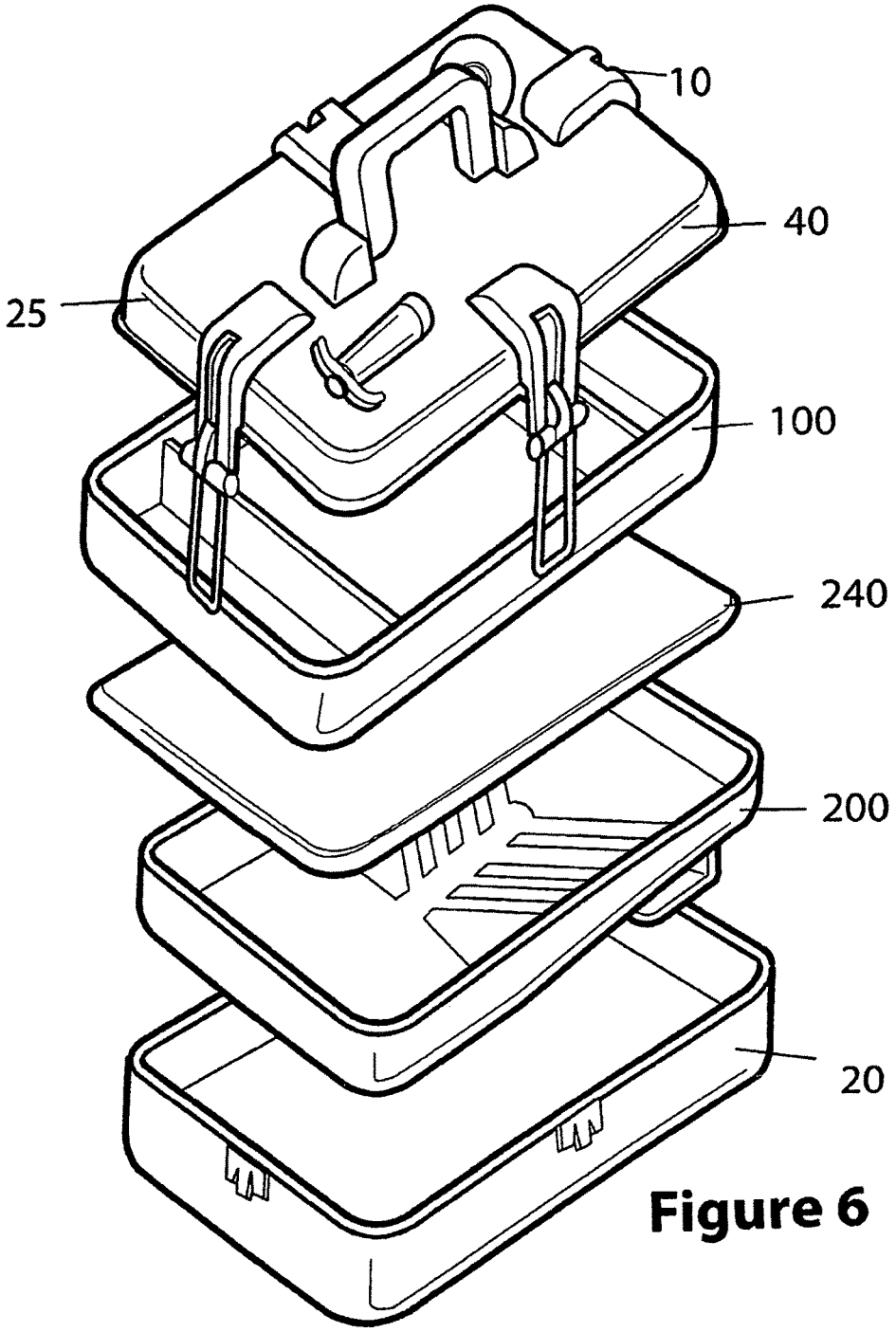
FIG. 6 illustrates side perspective view of the paint pal assembly.
Figure 8:
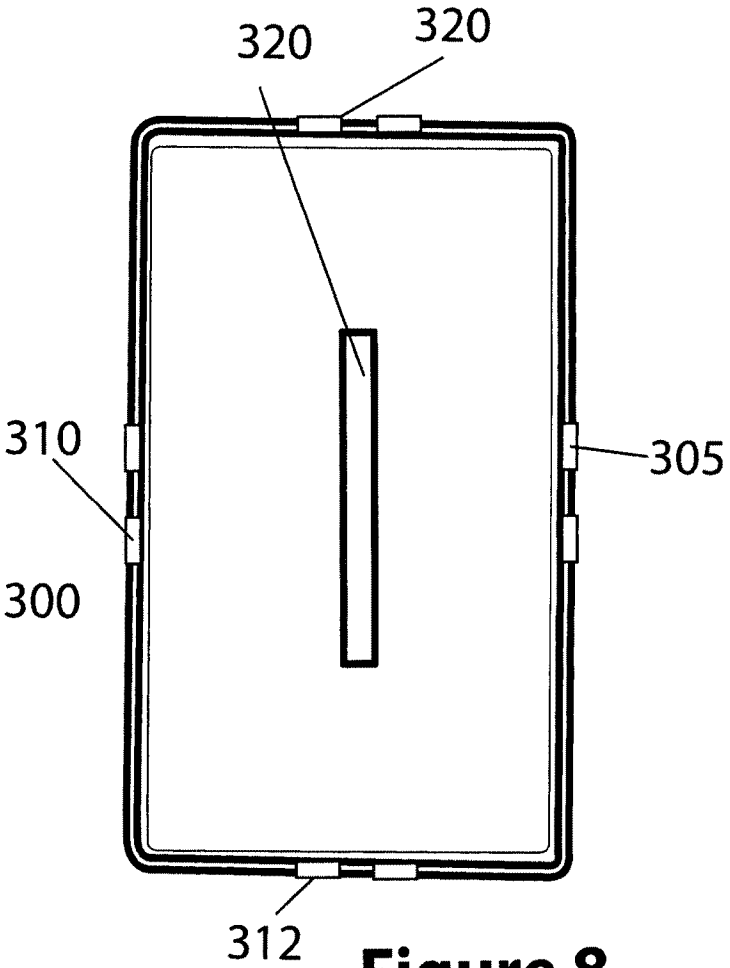
FIG. 8 is a top view of lid of the alternative embodiment.
Figure 7:
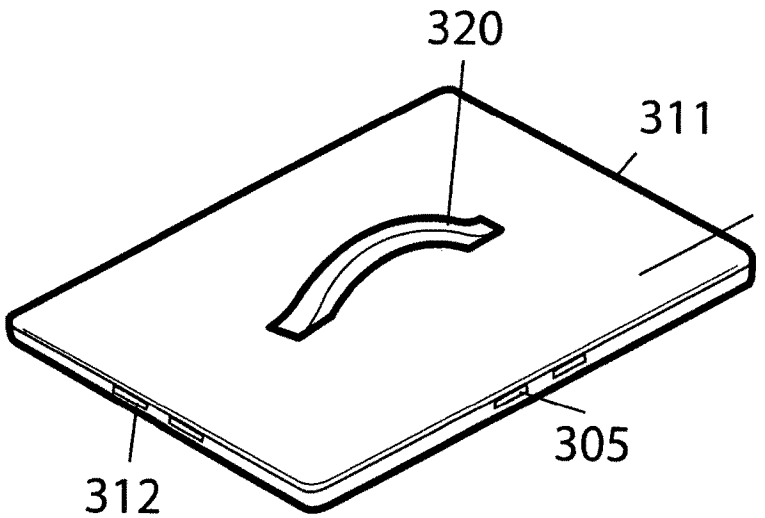
FIG. 7 is a perspective view of lid of the alternative embodiment.
Figure 9:
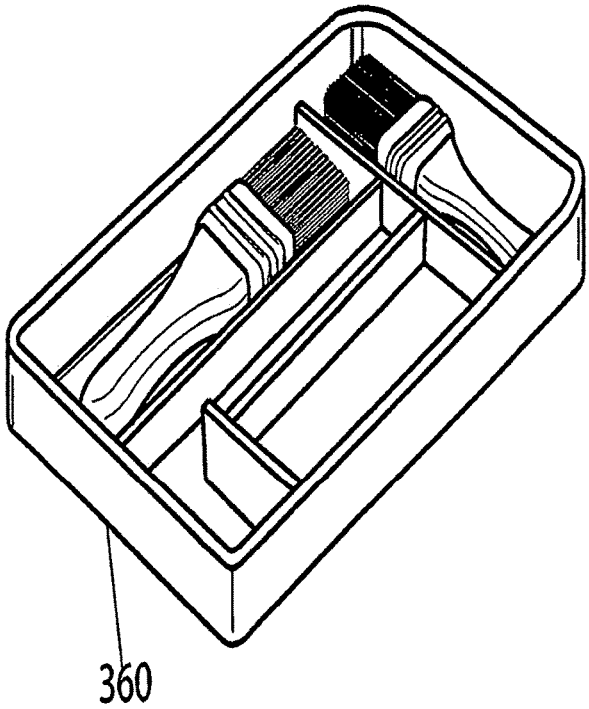
FIG. 9 is a top view of the compartment for the alternative view.
Figure 10:
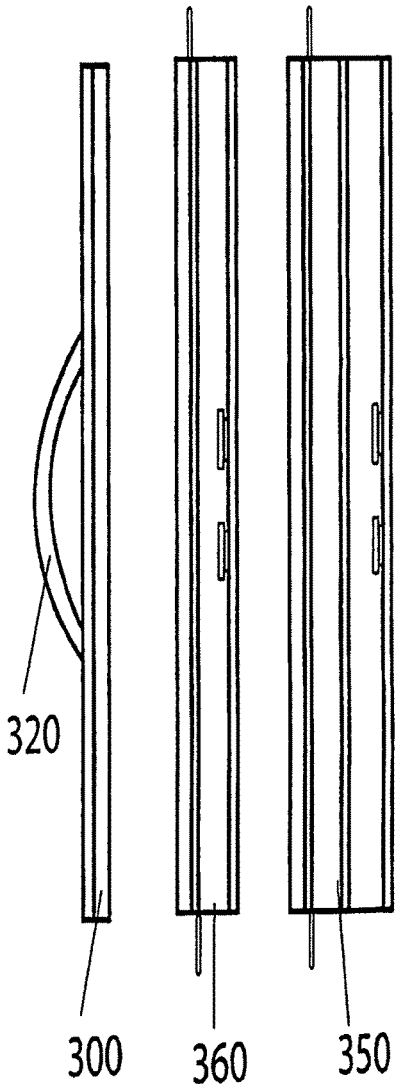
FIG. 10 is a side view of the housing unit for the alternative embodiment.
Figure 12:
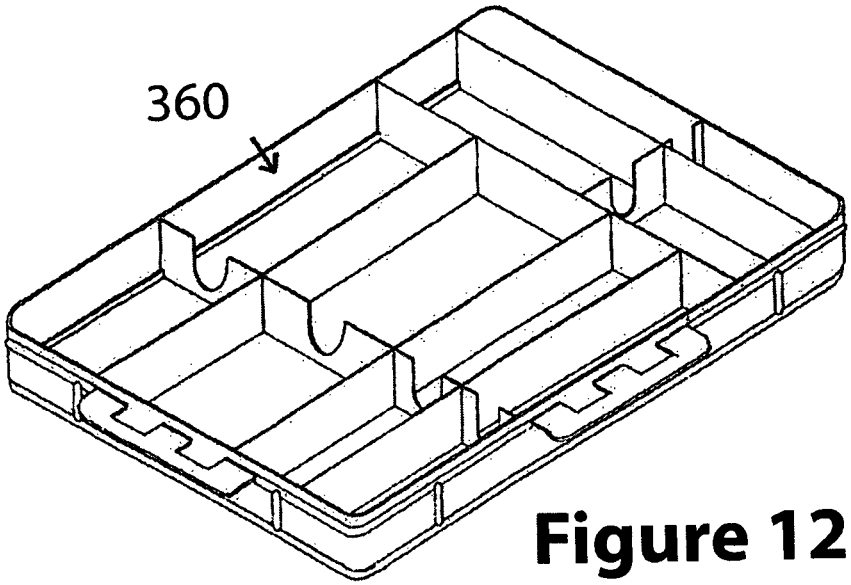
FIG. 12 is a cutaway view of the tray of the alternative embodiment.
Figure 11:
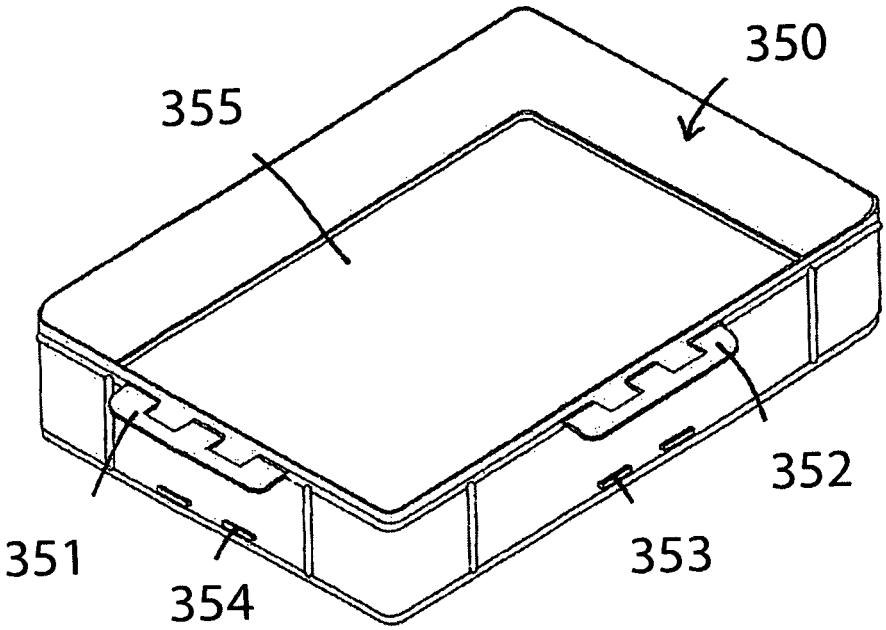
FIG. 11 is a cutaway view of the container of the alternative embodiment.
Figure 13:
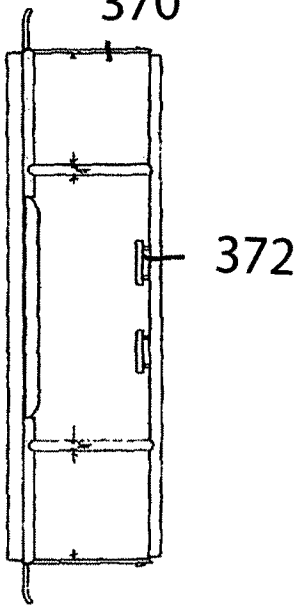
FIG. 13 is a cutaway view of the paint compartment from the front view.
Figure 15:
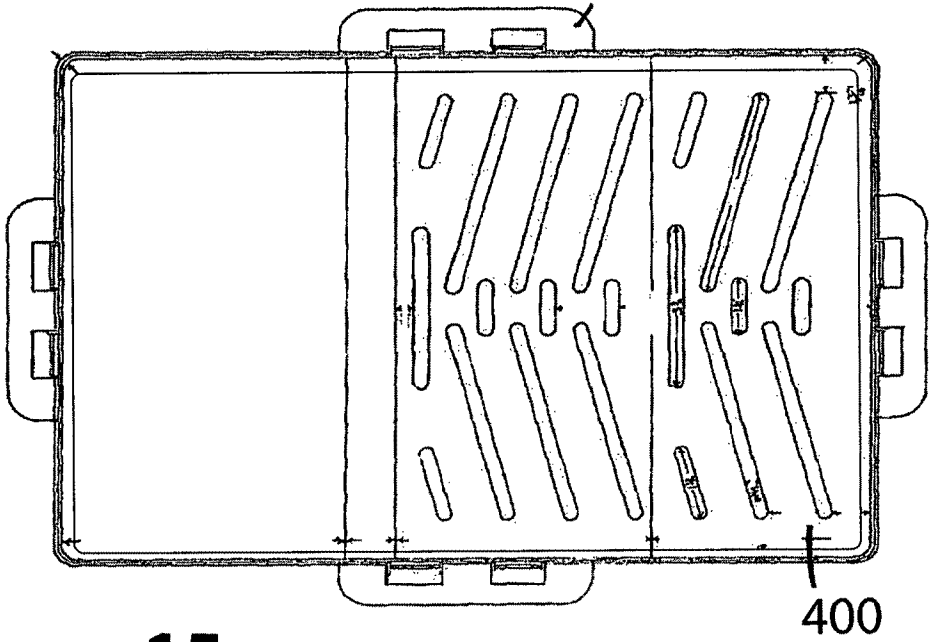
FIG. 15 is a cutaway view of the paint compartment from a top view.
Figure 14:
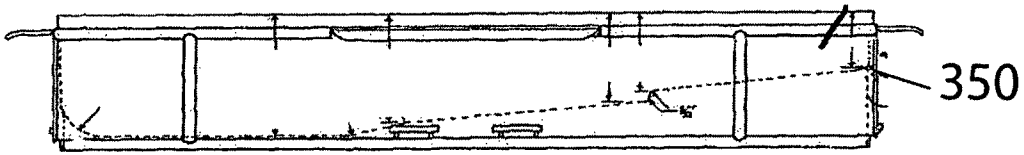
FIG. 14 is a cutaway view of the paint compartment from a side view.
Figure 16:
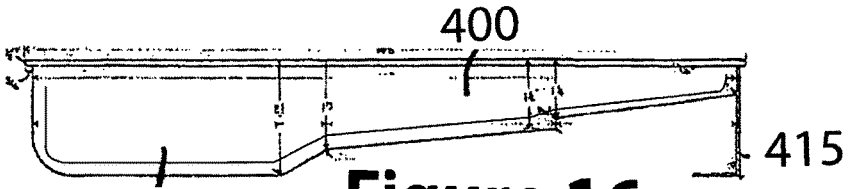
FIG. 16 is a side view of the paint compartment.
Figure 17:
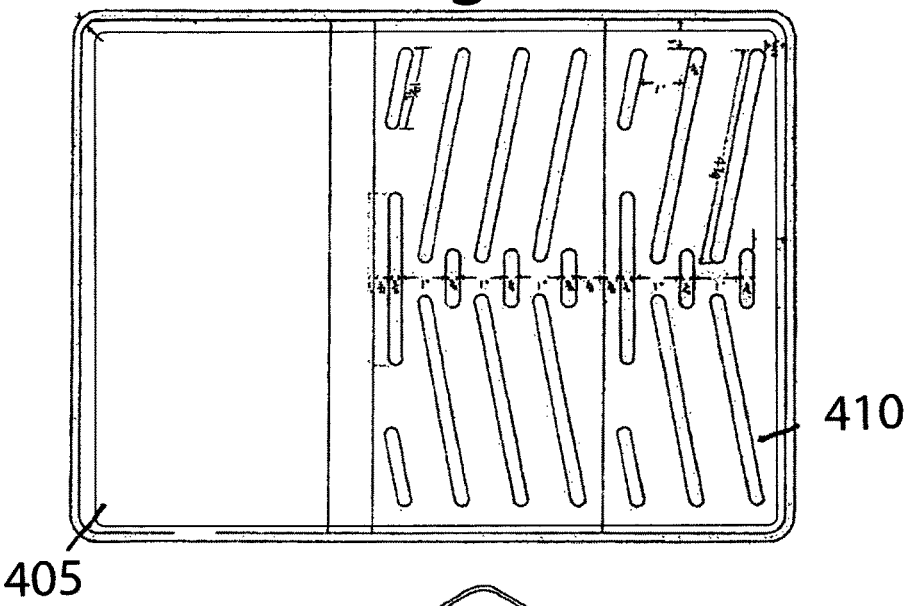
FIG. 17 is a top view of the paint compartment.
Figure 18:
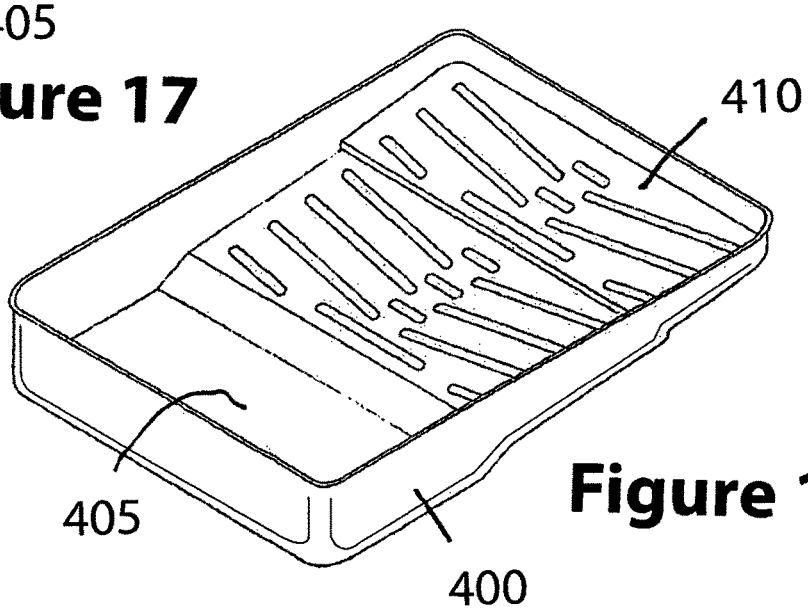
FIG. 18 is a top view of the paint compartment.
Figure 19:
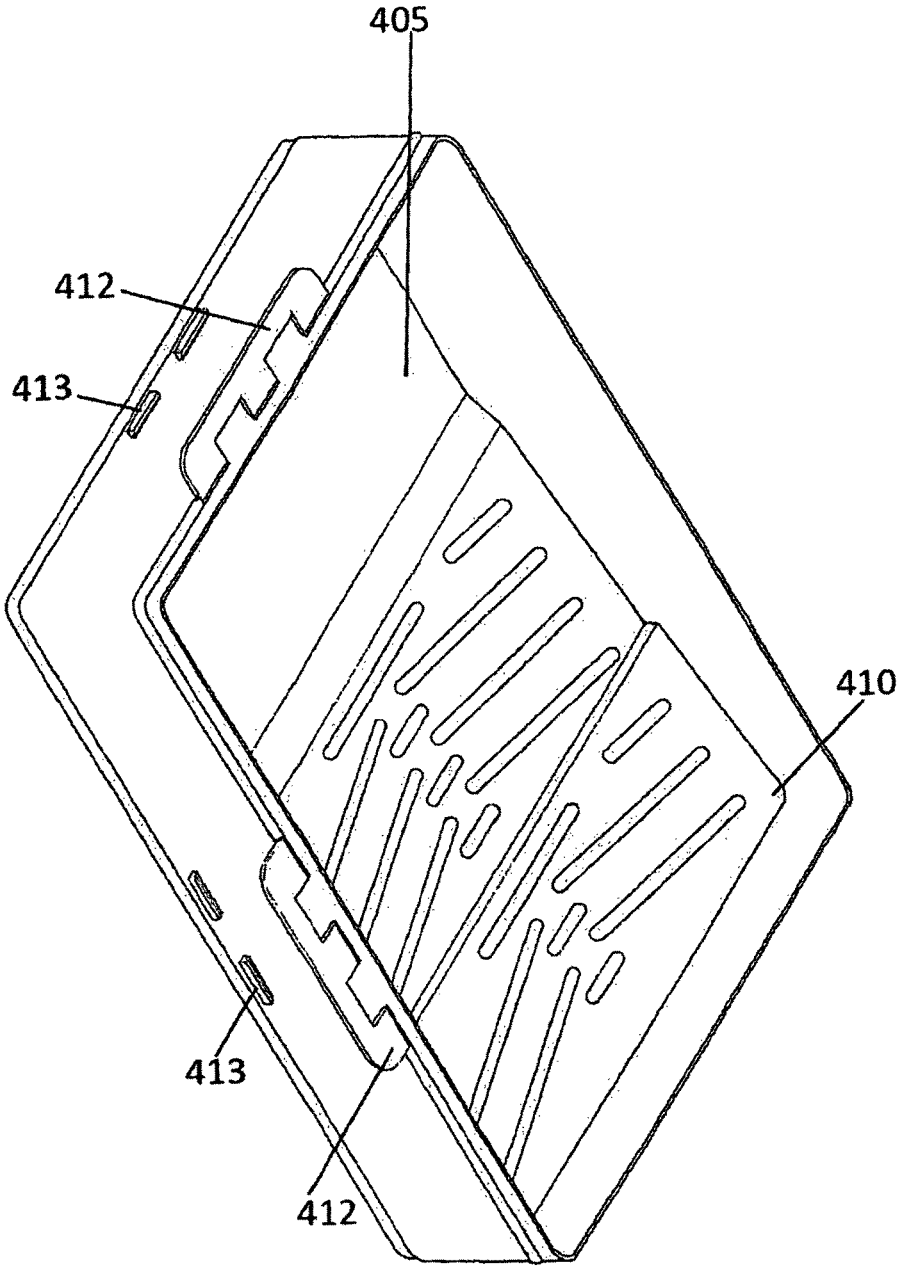
FIG. 19 is a top view of the paint tray within the container.

As shown in FIG. 6, there is shown a perspective view of the present invention, paint pal assembly 10. Paint pal assembly 10 further comprises organizer tool tray 100 and paint tray 200, and storage container 20.

Storage container 20 further comprises a detachable connected cover 25 with the outer peripheral edge is configured to mate with in an airtight seal arrangement with body 30. Body 30 is adapted and dimensioned to store organizer tool tray 100 and paint pan 200 therein.

In the preferred embodiment, as shown in FIG. 1*a*-*d*, body 30 comprises a rectangular shape with a plurality of interconnected walls defining a front wall 32, back wall 33, side wall 34 and an opposing side wall 35. Front wall 32 and back wall 33 runs the width of the body 30. Side wall 34 and opposing side wall 35 runs the width of body 30 The interior space of body 30 forms a cavity 36 dimensioned to received organizer tool tray 100 depicted in FIG. 4 and paint tray 200 depicted in FIG. 3. Ridge 37 surrounds the perimeter of cavity 36.

In the preferred embodiment, illustrated in FIG. 5*a*-*d*, cover 25 comprises a rectangular shape with a plurality of interconnected walls defining a front wall 42, back wall 43, side wall 44 and an opposing side wall 45. Front wall 42 and back wall 43 runs the width of the body 30. Side wall 44 and opposing side wall 45 runs the width of body 40. Ridge 47 surrounds the perimeter of cover 25 and is adapted to engage with ridge 37 of body (30) shown in FIG. 1B in an airtight seal arrangement. The airtight seal or vacuum seal can be further secured by fasteners attached to each wall of both cover 25 and container body 30. A vacuum port 41 can be situated on cover 40 to support the vacuum seal or airtight seal. In an opened position, cover 40 is removed from body 30 to allow for the entry and removal of organizer tool tray 100 and paint tray 200. A sealing mechanism such as a rubber seal (49) can encompass ridge seal (49). Pump 51 can be stored on the external surface of body (30) and works in conjunction with each vacuum port allowing the air to be extracted from each port. A plurality of vacuum ports can be disposed upon the surrounding walls of the container body 20 or upon the cover 25. In this embodiment, a recessed area can be configured upon the external surface area of cover 25 to receive pump 51. In other embodiments, the recessed area for the pump 51 can be configured upon the external wall of body 30. In use, the vacuum pump can be operationally engaged with a vacuum port 41 to extract the air from the housing unit. When the outer peripheral edge of cover 25 is engaged with the upper outer peripheral edge of body (30) a housing unit is formed to receive the paint tray and the tool organizer therein. After the air is pumped out of the housing unit, a vacuum seal is formed.

As depicted in FIG. 4*a*-4*d*, organizer tool tray 100 is designed with a plurality of compartments for receiving a plurality of paint tools. Tray body 101 comprises a rectangular shape with a plurality of interconnected walls defining a front wall 102, back wall 103, side wall 104 and an opposing side wall 105. Front wall 102 and back wall 103 runs the width of the body 101. Side wall 104 and opposing side wall 105 runs the length of body 101. The interior space of body 101 forms a cavity divided into the plurality of compartments. Near the back wall 103 of tray body 101 cavity section 120 is horizontally aligned near the upper end of tray body 101. Cavity section 121 is disposed above and abuts cavity section 122. Both cavity section 121 and cavity section 122 are aligned vertically below cavity section 120 on one side of tray body 101 near side wall 104. Cavity section 125 is disposed above and abuts cavity section 126. Both cavity section 125 and cavity section 126 are aligned vertically below cavity section 120 near the opposing side wall 105 of tray body 101. Center cavity 127 is centrally situated along the longitudinal axis below cavity section 120 and extends linearly downward therefrom to near the opposing end of the tray body 101 near front wall 102. Cavity section 101 forms a well for receiving a paint roller and center cavity 127 is adapted to receive the paint roller handle therein. The other cavities are designed to store paint brushes, scrapers, or other tools.

The present invention further comprises a specially designed ergonomic paint brush tool. The head of the brushes are also made out of a plastic that has micro grooves that hold more paint and the handle an ergonomic design.

In the preferred embodiment, as shown in FIG. 2*a*-2*d*, paint body 201 comprises a rectangular shape with a plurality of interconnected walls defining a front wall 202, back wall 203, side wall 204 and an opposing side wall 205. Front wall 202 and back wall 203 runs the width of the body 201. Side wall 204 and opposing side wall 205 runs the length of body 201. The interior space of body 201 forms a cavity 206 that is segmented into paint well 215 and roller platform 220. Ridge 207 surrounds the perimeter of cavity 206 running the length and width of the paint tray body 201. In this embodiment paint tray body 210 is larger than the conventional paint pan.

Paint well 215 is the region near the back wall 203 of interior cavity 206 and is the region with the lowest elevation in the interior cavity 206 of the body 201. Paint well 215 is intended to house the paint and to support the paint roller. The underside of paint well 215 acts has legs for the paint tray 200.

Paint platform 220 slopes downward within the interior cavity 206 from paint well 215 to the front wall 202 from the highest elevation level to the lowest elevated region. Along the interior surface of platform 220 are raised ribs that functions to remove excess paint from the paint roller. Disposed below front wall 202 is a leg member 235 that allows paint tray 200 to sit level on a flat surface. A plastic lining can be used to cover interior cavity 206 during use to allow for quick clean up.

Referring to FIG. 3*a*-3*d*, paint tray 200 further comprises a rectangular shape detachable connected lid 240. The perimeter edges running the length and width of lid 240 has a seal 209 adapted to mate with ridge 207 running the length and width of paint body 201 shown in FIG. 2. Vacuum port 208 is situated on lid to create a vacuum seal or in the alternative an air tight seal during storage. The vacuum seal maintains the moisture of the paint brushes and tools between use.

Figures 1A, 1C, 1D:
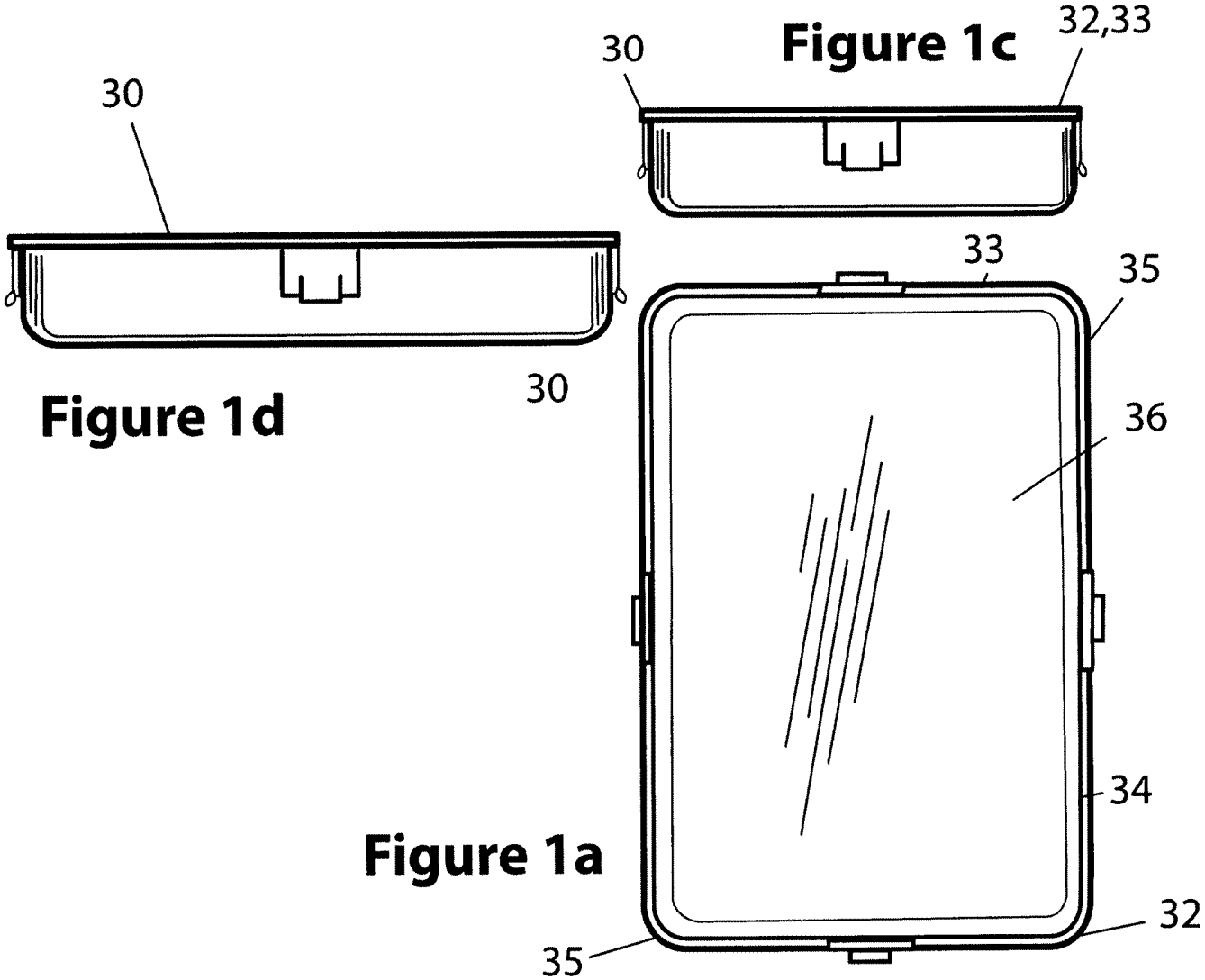
FIG. 1*a*-1*d* illustrates top view, bottom view, side view, and end view of the body of the storage container.
Figure 1B:
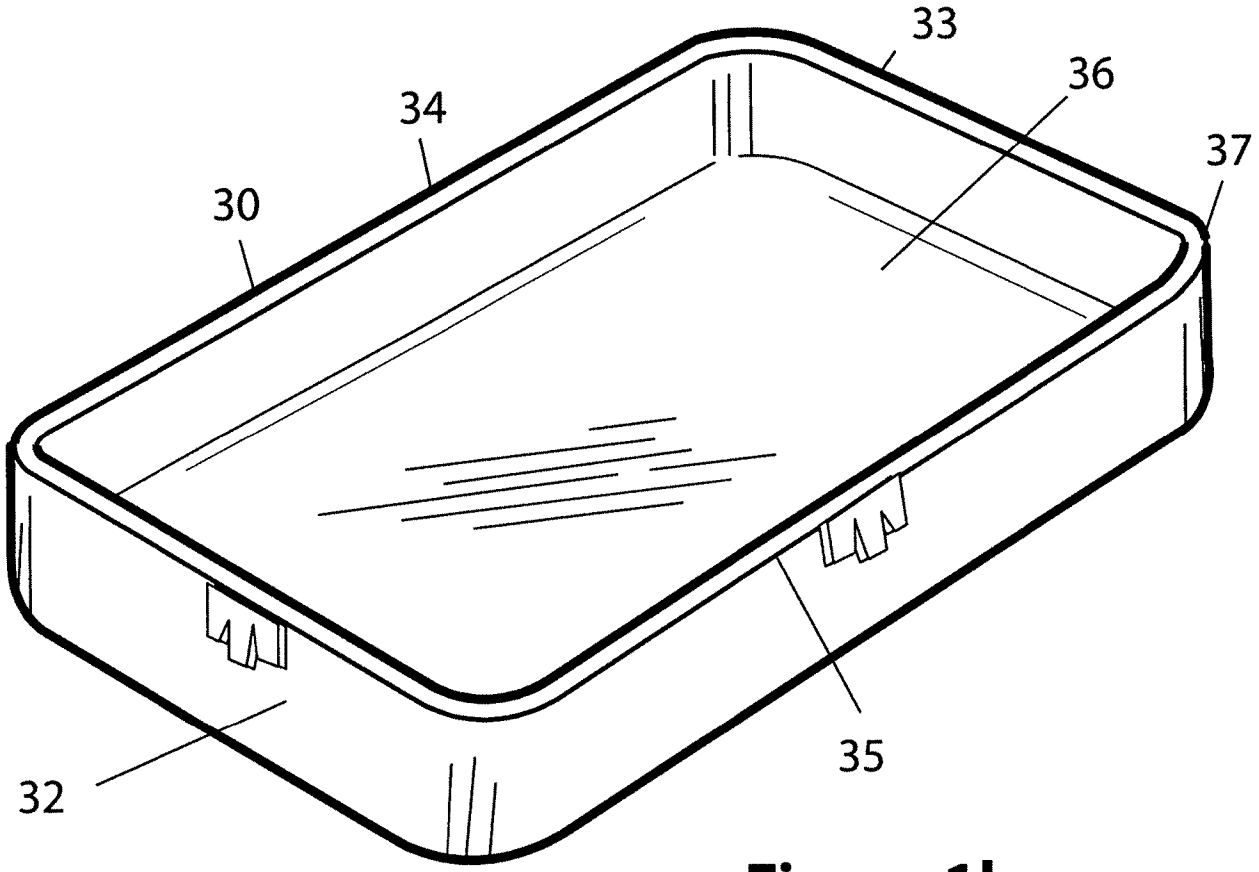
Figure 2A:
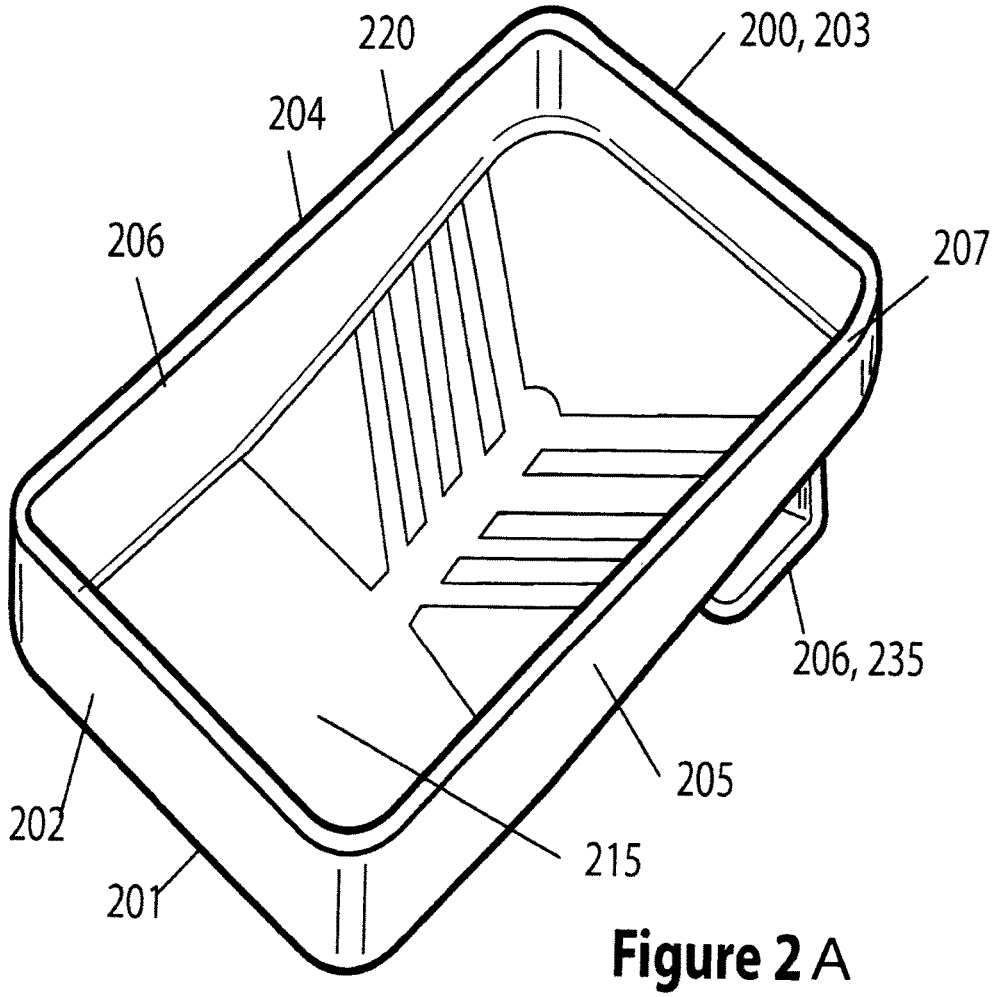
FIG. 2*a*-2*d* illustrates top view full, top view elongated, end view and side view of the paint roller tray.
Figures 2B, 2C, 2D:
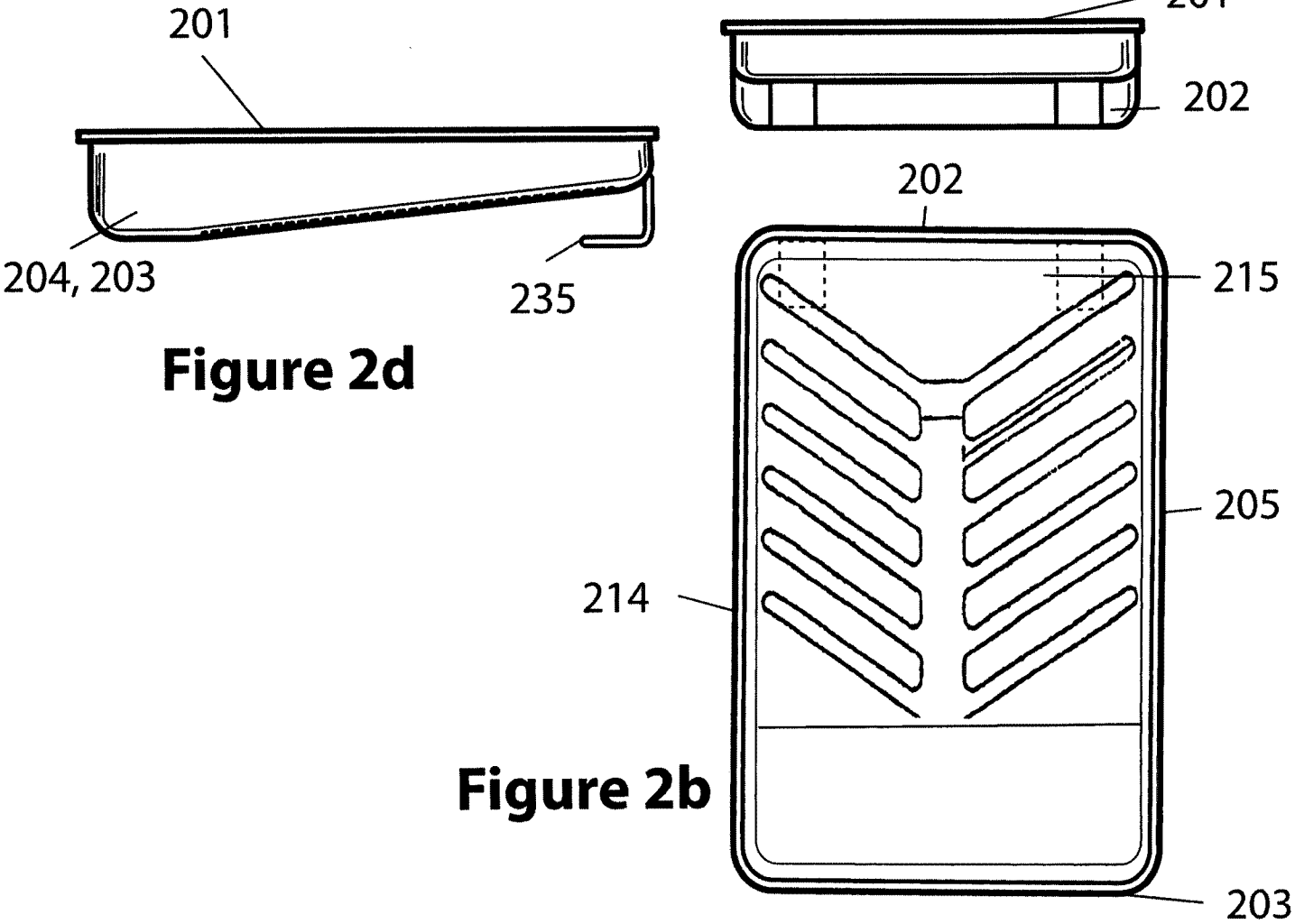
Figure 3A:
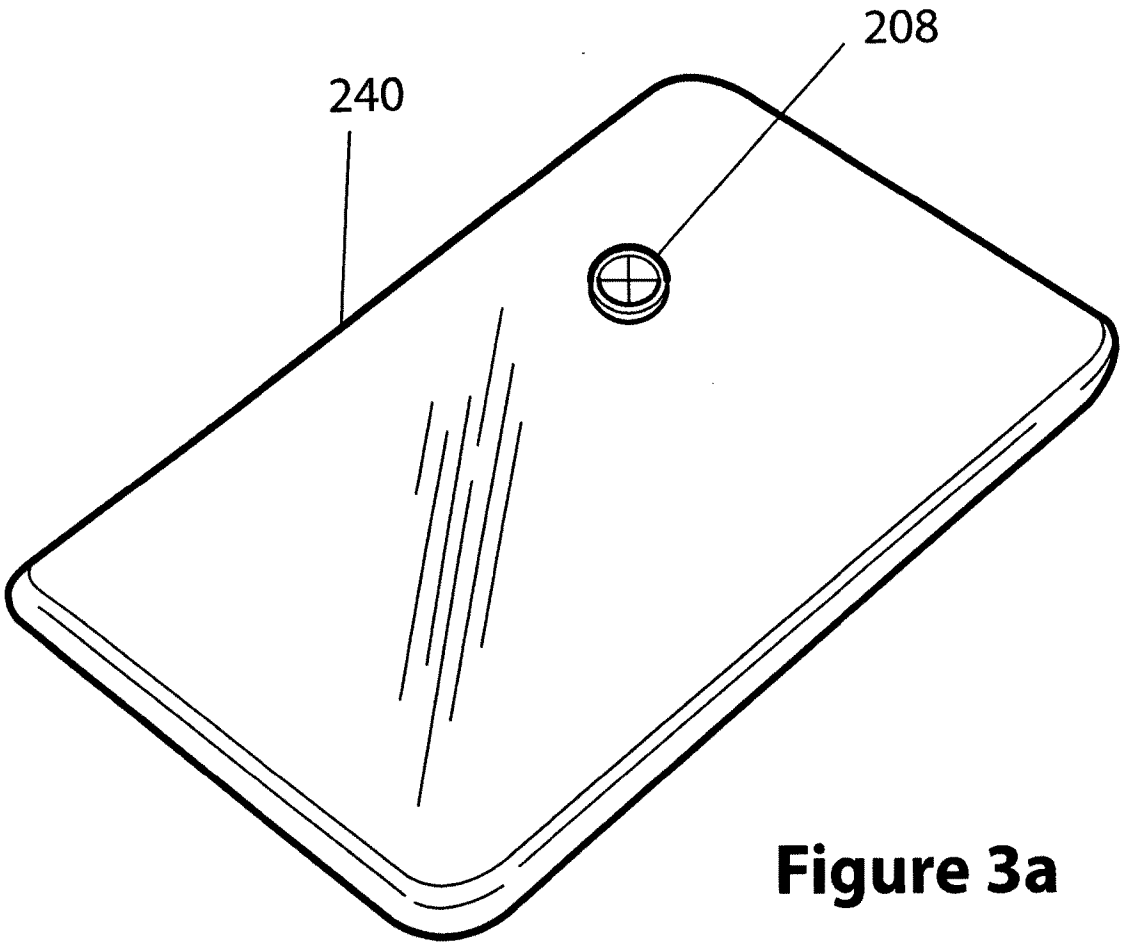
FIG. 3*a*-3*d* illustrates top view full, top view elongated, end view and side view of the paint roller tray lid.
Figure 3C:
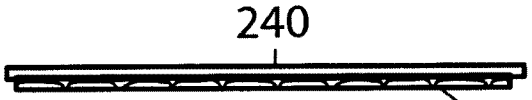
Figure 3D:
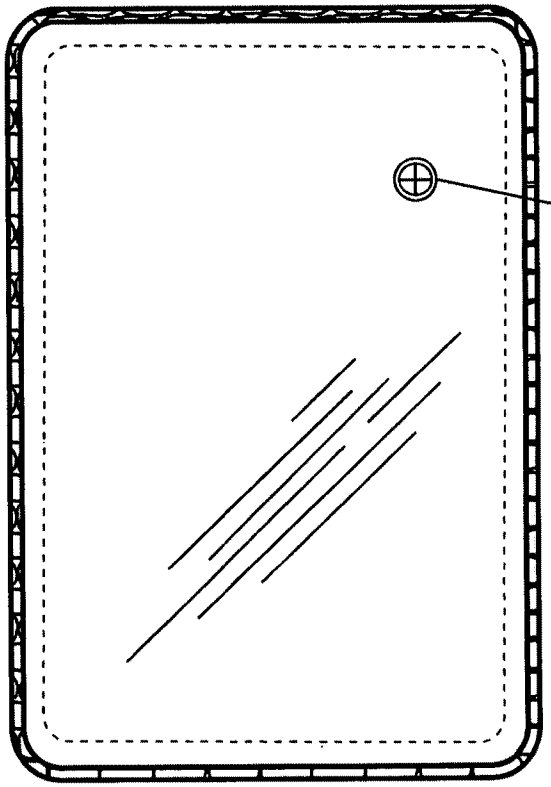
Figure 3B:
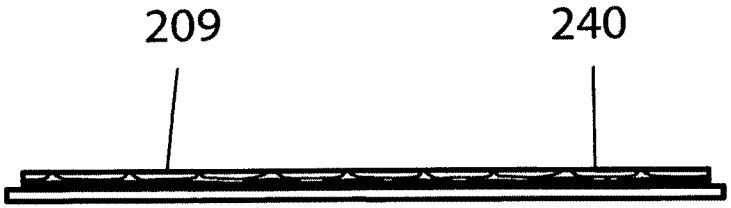
Figure 4A:
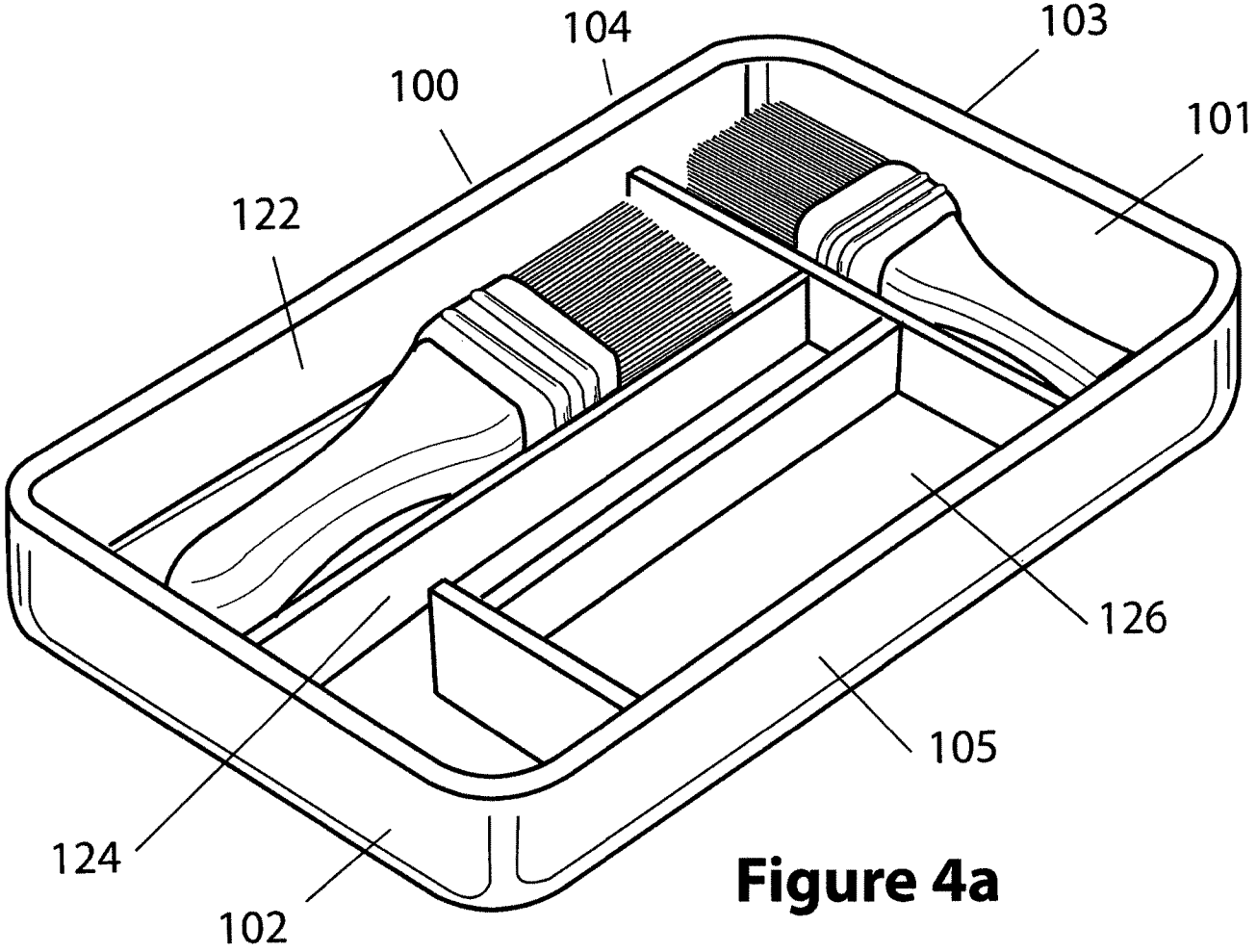
Figure 5B:
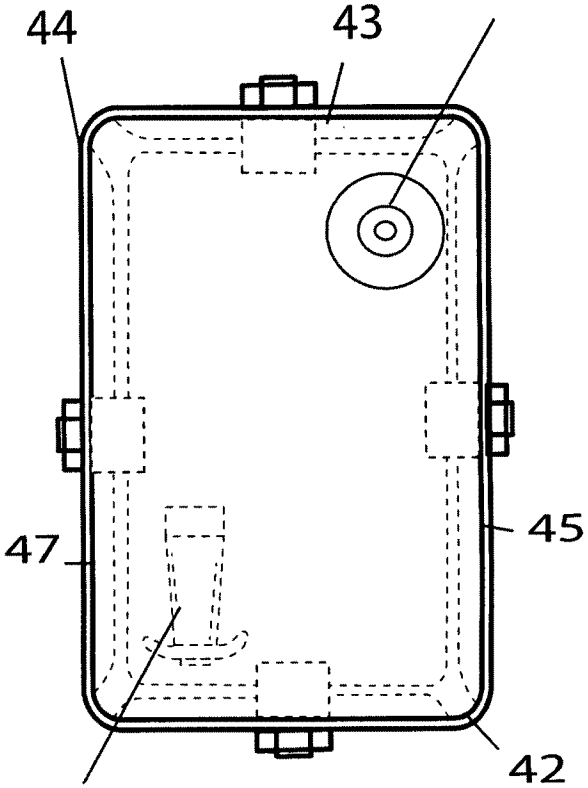
FIG. 5*a*-5*d* illustrates top view, bottom view, side view, and end view of the cover of the storage container.
Figure 5D:
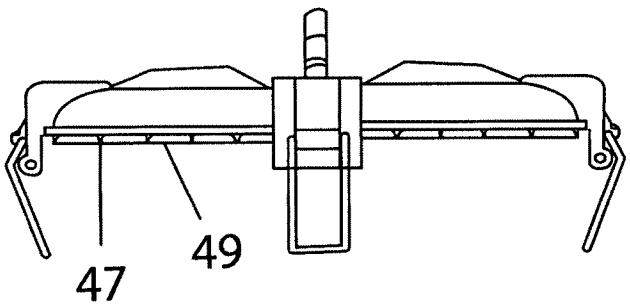
Figure 5A:
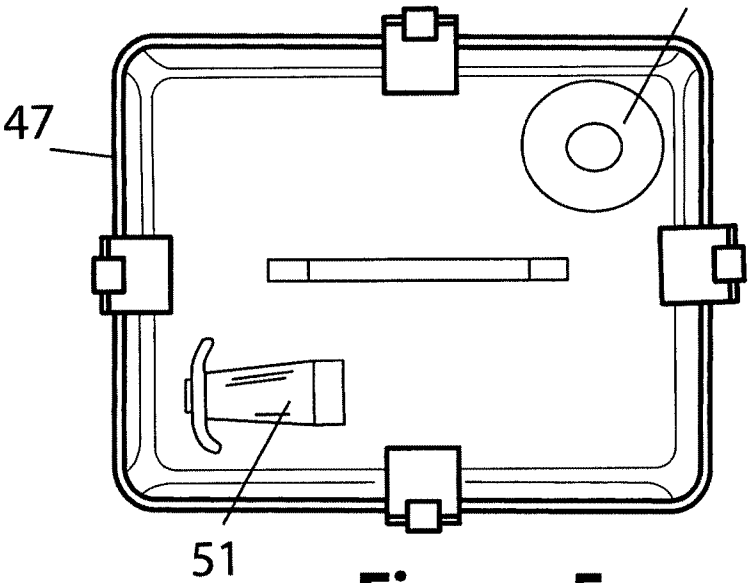
Figure 5C:
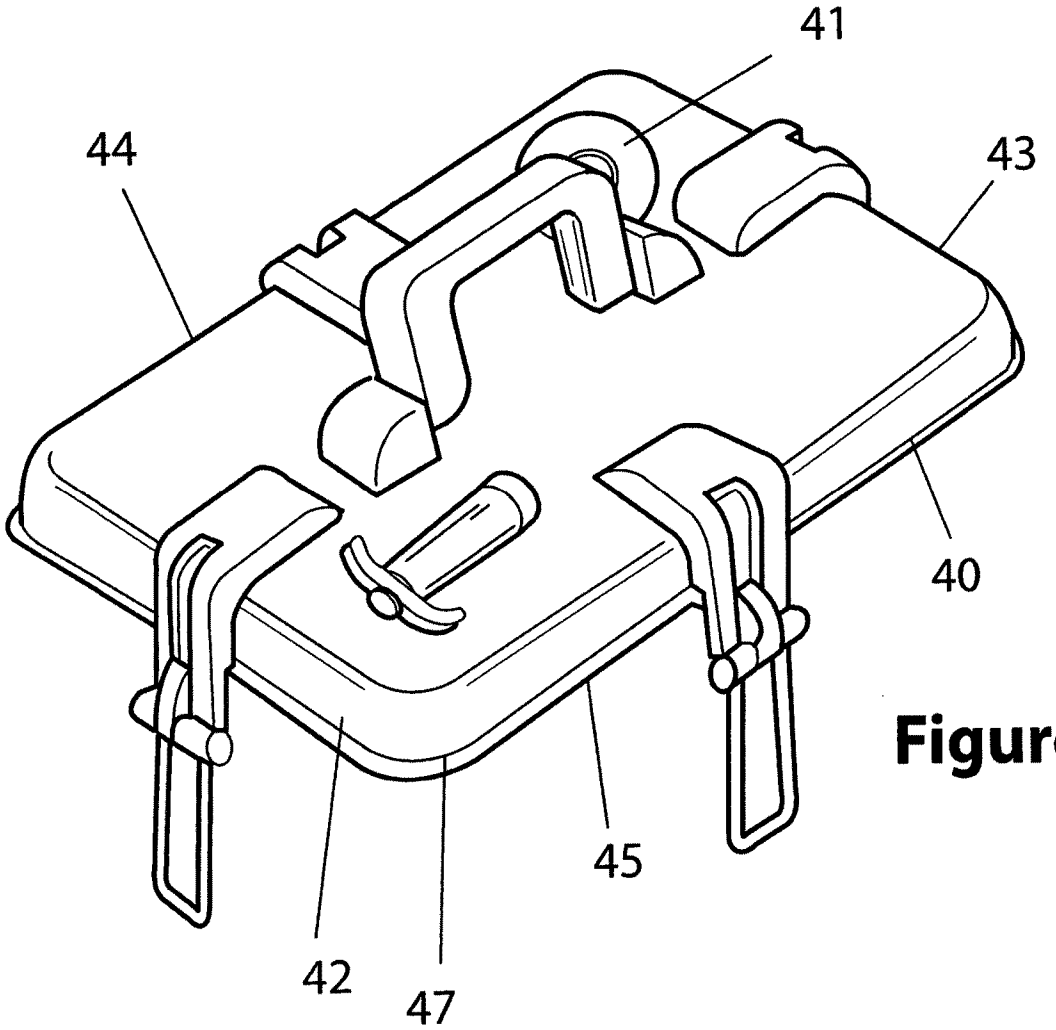

Referring to FIG. 7-19 there is shown an alternative embodiment of the present invention. As depicted the alternative embodiment comprises multiple stackable compartments wherein each engagement therebetween is in a vacuum seal arrangement. As shown the outer peripheral edge of lid (300) is configured to engage with the upper peripheral edge of upper storage compartment (360) in a vacuum seal arrangement. The organizer tray (360) is configured to seat within the upper storage compartment (360). Paint tray (400) is configured to seat within the lower storage compartment (350). The perimeter of the underside of upper storage compartment (360) is configured to seat upon the outer peripheral edge of lower storage compartment (350) in a vacuum seal arrangement. Paint tray (400) is configured as depicted in FIG. 2) and organizer tray (360) is configured as depicted in FIG. 4A). Laches 351 and 352 are attached to the outer peripheral edge of upper storage compartment (360) and laches 372 and 412 are attached to the outer peripheral edge of the lower storage compartment (350).

The invention claimed is:

1. A paint storage assembly comprising: a storage container enclosing a paint container; the storage container comprising: an outer body bounded by a bottom, a front wall, rear wall, and a pair of opposed sidewalls extending upward from said bottom forming a compartment; the front wall, the rear wall and the opposed sidewalls terminating in a perimeter rim of said outer body; an outer lid portion having a top surface extending downward to a surrounding rim; the surrounding rim of the outer lid portion releasably engaged upon the perimeter rim of said outer body wherein a storage space is if formed therebelow; a locking mechanism cooperatively engaged between the outer lid portion and the perimeter rim of the outer body such that a vacuum seal arrangement is formed; the paint container comprising: an inner lid portion and an inner body portion comprising a bottom, a front wall a rear wall, and a pair of opposed sidewalls extending upward from said bottom; said front wall, rear wall and opposed sidewalls terminating in a surrounding peripheral edge; the inner lid portion and the inner body portion having dimensions for being seated within the compartment of said outer body; the surrounding peripheral edge of the inner lid portion configured to releasably engage with the surrounding peripheral edge of the inner body portion; the outer body of the storage container further comprises a vacuum port incorporated upon an external surface area section and a reservoir portion formed adjacent to the front wall and incorporated therein—wherein the storage container is formed for storing painting supplies therein.

2. The assembly of claim 1 wherein the storage container further comprises:

a component container enclosed within the storage space below the outer lid portion above the inner lid portion paint container;

the component container comprising:

a upper body portion comprising a bottom, a front wall, a rear wall, and a pair of opposed sidewalls extending upward from said bottom, said front wall, rear wall and opposed sidewalls terminating in a surrounding peripheral edge and forming a upper cavity;

an underside of the bottom wall disposed above the inner lid portion of the paint container;

the upper cavity segmented into a first section adjacent to the front wall, an opposing second section adjacent to the back wall.

3. The assembly of claim 2 wherein the storage container further comprises:

a third section parallel to and adjacent to a fourth section: the third and fourth section disposed between and perpendicular to the first section and the opposing second section.

4. The assembly of claim 1 wherein the outer lid portion further comprises a handle fixably attached to the top surface of the outer lid portion.

5. The assembly of claim 1 wherein the outer body further comprises a sealing mechanism surrounding the perimeter rim and providing a vacuum seal with the outer lid portion.

6. The assembly of claim 1 wherein the inner body portion further comprises at least one leg members are attached to the underside of the bottom wall near rear wall.

7. The assembly of claim 1 wherein the locking mechanism further comprises:

at least one a female locking member mounted upon a section of the surrounding rim of the outer lid portion;

at least one corresponding mating male locking member mounted upon a section of the perimeter rim of said outer body wherein the female locking member and the mating male locking member are securely engaged to form a vacuum seal.

8. The assembly of claim 1 wherein the outer body of the storage container a pump attached to the underside of the bottom wall of the storage container.

9. The assembly of claim 1 wherein the outer body of the storage container further comprises a pump attached to the top surface of the storage container.

10. The assembly of claim 1 wherein the inner lid portion of the paint container has a flat surface.

11. The assembly of claim 10 wherein the inner body portion abuts the flat surface of the inner lid portion.

* * * * *